US008443540B2

(12) United States Patent
Poling

(10) Patent No.: US 8,443,540 B2
(45) Date of Patent: May 21, 2013

(54) BIPOD LEG MOUNTING BODY AND BIPOD COMPRISING SAME

(76) Inventor: Dale Avery Poling, Potomac, MT (US)

( * ) Notice: Subject to any disclaimer, the term of this patent is extended or adjusted under 35 U.S.C. 154(b) by 123 days.

(21) Appl. No.: 12/930,574

(22) Filed: Jan. 11, 2011

(65) Prior Publication Data

US 2012/0174459 A1 Jul. 12, 2012

(51) Int. Cl.
*F41A 23/16* (2006.01)

(52) U.S. Cl.
USPC ..... 42/94; 89/37.04; 248/163.1

(58) Field of Classification Search
USPC ..... 42/94; 89/37.04, 37.05; 248/163.1, 248/163.2
See application file for complete search history.

(56) References Cited

U.S. PATENT DOCUMENTS

| | | | | |
|---|---|---|---|---|
| 2,420,267 | A * | 5/1947 | Sefried | 42/94 |
| 7,478,496 | B2 * | 1/2009 | Bender | 42/94 |
| 2010/0218411 | A1 * | 9/2010 | Keng | 42/94 |

* cited by examiner

*Primary Examiner* — Daniel J Troy
(74) *Attorney, Agent, or Firm* — David O. Simmons

(57) ABSTRACT

A bipod kit for a firearm has a bipod leg mounting body and a firearm structural component. The bipod leg mounting body has a substantially round central passage defining an interior side surface thereof and has two leg mounting structures on an exterior side surface thereof generally opposite the interior side surface. The firearm structural component is mountable on the firearm at an OEM (original equipment manufacturer) mounting structure thereof. The firearm structural component includes a bipod mounting portion integral therewith. The bipod mounting portion is cylindrical and is rotatably mounted within the central passage of the bipod leg mounting body. The bipod mounting portion is configured such that a barrel of the firearm extends through a central passage thereof when the firearm structural component is mounted on the firearm at the OEM mounting structure thereof.

10 Claims, 1 Drawing Sheet

BIPOD LEG MOUNTING BODY AND BIPOD COMPRISING SAME

FIELD OF THE DISCLOSURE

The disclosures made herein relate generally to firearm accessories and, more particularly, to a bipod having a mounting ring to which a firearm is rotatably mounted.

BACKGROUND

A bipod is an essential asset to many shooters. It provides them with a solid platform for making accurate shots from a prone shooting position. To this end, in most cases, a shooter will configure his or her bipod for their particular prone shooting position. This will typically include setting legs of the bipod to a length corresponding to their prone shooting position.

One drawback of conventional bipods is that they offer no means for readily accommodating uneven surfaces upon which the legs of the bipod might come to rest when a shooter sets up in their prone shooting position. For example, with the bipod legs having been pre-set by the shooter for a level shooting surface, the shooter will find that their firearm is not in a preferred shooting position when one leg of the bipod comes to rest on an obstruction such as a rock or within a depression. In many situations (e.g., a hostile environment), it is not practical or possible for the shooter to re-position the bipod or reconfigure the bipod (e.g., adjust leg length) so as to achieve a bipod orientation that puts their firearm in a preferred shooting position.

Therefore, a bipod configured in a manner that overcomes drawbacks associated with conventional bipods would be advantageous, desirable and useful.

SUMMARY OF THE DISCLOSURE

Embodiments of the present invention relate to a bipod (i.e., a bipod) configured in a manner that overcomes drawbacks associated with conventional bipods. Unlike conventional bipods, a bipod configured in accordance with present invention overcomes provides a means for readily accommodating uneven surfaces upon which the legs of the bipod might come to rest when a shooter sets up in their prone shooting position. For example, with the bipod legs having been pre-set by the shooter for a level shooting surface, a bipod configured in accordance with the present invention allows for the firearm to be rotated about an axis extending parallel to a longitudinal axis of the barrel of the firearm. In this manner, when one leg of the bipod comes to rest on an obstruction such as a rock or within a depression, the shooter will be able to rotate the firearm to position the firearm in a preferred shooting position. As such, with a bipod configured in accordance with the present invention, it is readily possible for the shooter to rotationally reposition the firearm with respect to the bipod so as to put the firearm in a preferred shooting position.

In one embodiment of the present invention, a bipod for a firearm comprises a first mounting body and a second mounting body. The first mounting body has two leg mounting structures integral with an exterior surface thereof and has a central passage extending therethrough. The second mounting body is rotatably mounted within central passage of the first mounting body. The second mounting includes a firearm mounting structure integral therewith and has a passage extending therethrough. The firearm mounting structure and the passage are jointly configured such that a barrel of the firearm extends through the passage of the second mounting body when the firearm is engaged with the firearm mounting structure.

In another embodiment of the present invention, a bipod ring for a firearm bipod comprises a body having a substantially round central passage defining an interior side surface thereof and having two leg mounting structures extending from an exterior side surface thereof generally opposite the interior side surface. Each one of leg mounting structures includes a leg retention feature defining a respective leg rotational axis thereof. The leg retention feature of each one of the leg mounting structures lies on the same side of a plane extending through an axis of rotation of the firearm mounting body with respect to the bipod leg mounting body.

In another embodiment of the present invention, a bipod kit for a firearm comprises a bipod leg mounting body and a firearm structural component. The bipod leg mounting body has a substantially round central passage defining an interior side surface thereof and has two leg mounting structures on an exterior side surface thereof generally opposite the interior side surface. The firearm structural component is mountable on the firearm at an OEM (original equipment manufacturer) mounting structure thereof. The firearm structural component includes a bipod mounting portion integral therewith. The bipod mounting portion is cylindrical and is rotatably mounted within the central passage of the bipod leg mounting body. The bipod mounting portion is configured such that a barrel of the firearm extends through a central passage thereof when the firearm structural component is mounted on the firearm at the OEM mounting structure thereof.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
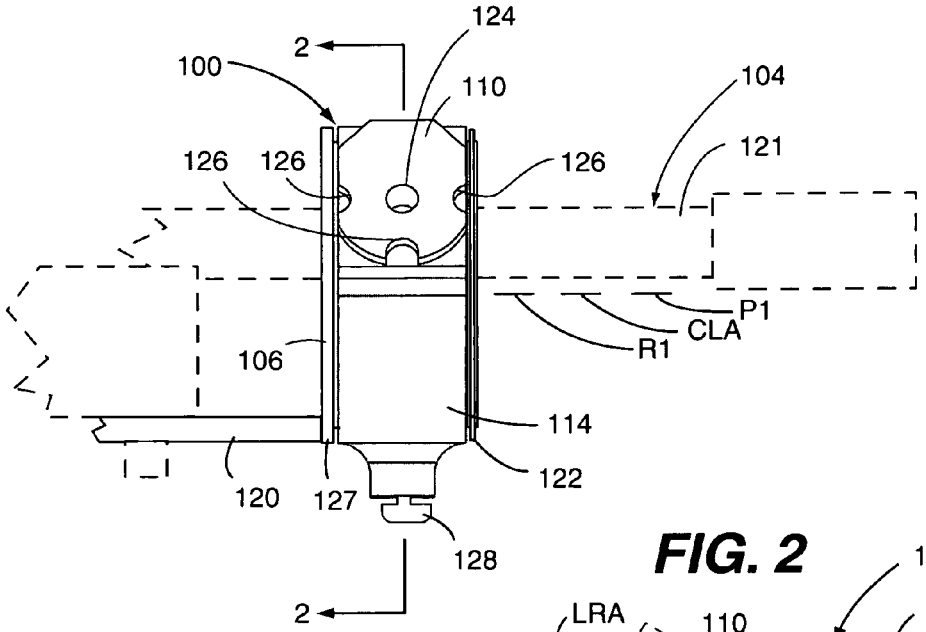
FIG. 1 is a side view of a bipod configured in accordance with the present invention.
Figure 2:
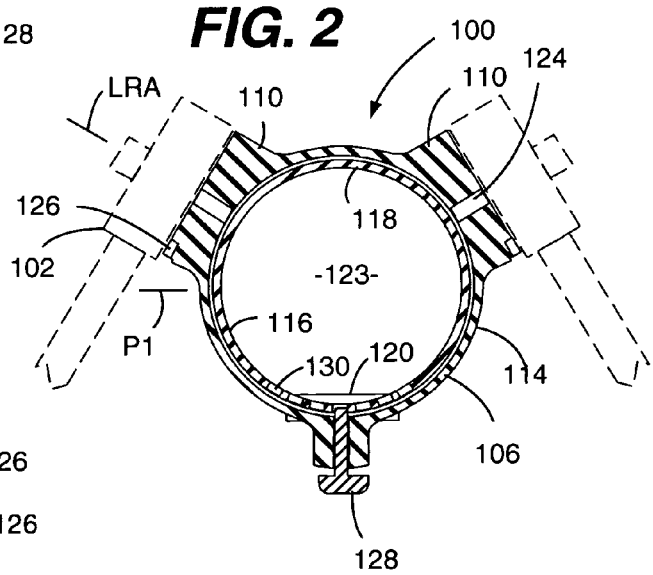
FIG. 2 is a cross-sectional view taken along the line 2-2 in FIG. 1.

FIGS. 1 and 2 show a bipod 100 configured in accordance with an embodiment of the present invention. In FIG. 1, legs 102 of the bipod 100 are omitted for clarity. In FIG. 2, a firearm 104 attached to the bipod 100 is omitted for clarity. The bipod 100 is configured for accommodating uneven surfaces upon which legs 102 of the bipod 100 might come to rest when a shooter sets up in their prone shooting position to shoot a firearm 104 attached to the firearm 104. For example, with the legs 102 having been pre-set (e.g., to a prescribed length) by the shooter for a level shooting surface, the bipod 100 allows for a firearm 104 attached to the bipod 100 to be rotated about an axis extending parallel to a longitudinal axis of the barrel of the firearm. In this manner, when one or both of the legs 102 comes to rest on an obstruction or within a depression such that the firearm 104 is not in the shooter's preferred shooting position, the bipod 100 allows the shooter to rotate the firearm 104 to a position in which the firearm 104 in a preferred shooting position. As such, with a bipod configured in accordance with he present invention, it is readily possible for the shooter to quickly and simply rotationally reposition a firearm with respect to legs of the bipod so as to put the firearm in the preferred shooting position.

Figure 3:
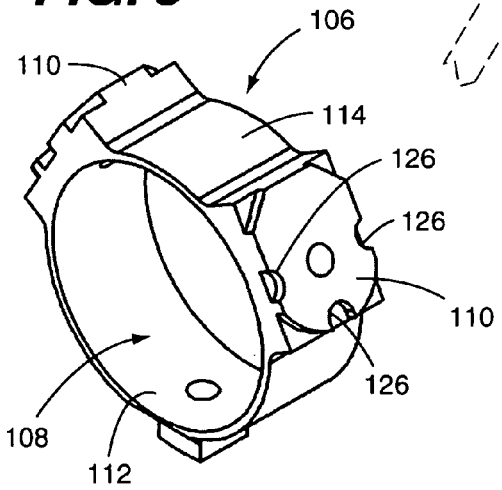
FIG. 3 is a perspective view showing a bipod rind of the bipod of FIG. 1.

Referring to FIGS. 1-3, a bipod leg mounting body 106 (i.e., a first mounting body) of the bipod 100 has a central passage 108 and two leg mounting structures 110. The central passage 108 is preferably substantially round and defines an interior side surface 112 of the bipod leg mounting body 106. The leg mounting structures 110 extend from an exterior side surface 114 of the bipod leg mounting body 106. The exterior side surface 114 is generally opposite the interior side surface 112. Preferably, the exterior side surface 114 extends generally parallel to the interior side surface 112 such that the bipod leg mounting body 106 is generally cylindrical and is thus also referred herein to as a bipod ring. The leg mounting structures 110 extend outwardly from the exterior side surface 114 of the bipod leg mounting body 106.

Referring to FIGS. 1 and 2, a firearm mounting body 116 (i.e., a second mounting body) of the bipod 100 has a cylindrical portion 118 and a firearm attachment portion 120 attached to the cylindrical portion 118. The cylindrical portion 118 is rotatably mounted within the central passage 108 of the bipod leg mounting body 106 such that a rotational axis R1 of the cylindrical portion 118 with respect to the bipod leg mounting body 106 extends along a centerline longitudinal axis CLA of the central passage 108 of the bipod leg mounting body 106. The firearm mounting body 116 is configured such that a barrel 121 of the firearm 104 extends through a central passage 123 of the cylindrical portion 118 when the firearm attachment portion 120 is attached to the firearm 104. As shown, the interior side surface 112 of the bipod leg mounting body 106 and a mating exterior surface 125 of the cylindrical portion 118 are both substantially smooth. Alternatively, the interior side surface 112 of the bipod leg mounting body 106 or the exterior surface 125 of the cylindrical portion 118 can have a plurality of protrusions (e.g., ribs or detents) so as to reduce the potential for adverse affect of contaminants within the sliding interface between the bipod leg mounting body 106 and the cylindrical portion 118. It is also contemplated herein that a bearing or bushing can be provided between the bipod leg mounting body 106 and the cylindrical portion 118 for affecting rotation therebetween.

The cylindrical portion 118 is retained within the central passage 108 by any suitable means for retention that allows rotation of the cylindrical portion 118 with respect to the bipod leg mounting body 106. As shown in FIG. 1, the means for retention can include a shoulder 127 on a first end of the cylindrical portion 118 and a c-clip 122 engaged within a groove at the second end of the cylindrical portion 118 thereby capturing the bipod leg mounting body 106 between the shoulder 127 and the c-clip 122. In another embodiment, the means for retention can include a threaded fastener fixedly engaged with the bipod leg mounting body 106 and extending into a slot within the cylindrical portion 118.

The firearm attachment portion 120 is configured for being attached to the firearm 104. It is disclosed herein that the firearm attachment portion 120 can be suitably configured to be attached to a structural component of a firearm such as, for example, the barrel, a receiver, an accessory mounting rail of the like. In this manner, the bipod 100 can be fixedly attached to the firearm 104.

Each one of the leg mounting structures 110 includes a leg retention feature 124 (e.g., a threaded hole) configured for allowing the legs 102 to be attached to the bipod leg mounting body 106. Each leg retention feature 124 defines a respective leg rotational axis LRA. Preferably, the leg retention feature 124 of each one of the leg mounting structures 110 lies on the same side of a plane P1 extending through an axis of rotation R1 of the cylindrical portion 110 with respect to the bipod leg mounting body 106. Preferably, the leg retention feature 124 of each one of the leg mounting structures 110 is above the plane P1 when the bipod leg mounting body 106 is mounted on the firearm 104. Preferably, the respective leg rotational axis LRA of each one of the leg mounting structures 110 extends generally perpendicular to the rotational axis R1 of the cylindrical portion 118 and intersect each other at a location above the plane P1. Alternatively, the leg retention feature 124 of each one of the leg mounting structures 110 can be diametrically opposed to each other and/or can be below the plane P1 when the bipod leg mounting body 106 is mounted on the firearm 104.

Each leg mounting structures 110 also includes a plurality of leg positioning features 126 (e.g., recesses). The leg positioning features 126 are selectively engagable by a mating feature of a respective one of the legs 102 during rotation of the legs 102 (e.g., from a deployed position shown in FIG. 2 to a stowed position (e.g., rotated 90 degrees fore or aft of the deployed position)). For example, a spring-biased ball within each one of the legs 102 can selectively engage the leg positioning features 126 for securing each leg 102 in a position corresponding to the engaged one of the leg positioning features 126.

The bipod leg mounting body 106 and the firearm mounting body 116 can be jointly configured for allowing the firearm mounting body 116 to be secured in a prescribed rotational position with respect to the bipod leg mounting body 106. For example, as shown in FIG. 2, a locking member 128 engaged with the bipod leg mounting body 106 can extend into one of a plurality of spaced part apertures 130 in the cylindrical portion 118. In this manner, an angular orientation of the firearm mounting body 116 with respect to the bipod leg mounting body 106 can be selectively fixed.

In one embodiment of the present invention, the bipod is provided in the form of a kit. The kit includes the bipod mounting leg body 106 (i.e., a bipod mounting leg body) and the firearm mounting body 116 (i.e., a firearm structural component). Accordingly, in one embodiment of the present invention, a bipod mounting portion is the cylindrical portion 118. Preferably, the firearm mounting body 116 is mountable on a firearm at an OEM (original equipment manufacturer) mounting structure (e.g., a barrel, receiver, accessory mounting rail, handgrip, etc). Preferably, the bipod mounting portion is configured such that the barrel 121 of the firearm 104 extends through the central passage 108 when the firearm mounting body 116 is mounted on the firearm 104 at the OEM mounting structure thereof.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A bipod for a firearm, comprising:

a plurality of bipod legs;

a first mounting body having two leg mounting structures integral with an exterior surface thereof and having a central passage extending therethrough, wherein the central passage of the first mounting body is substantially round, wherein each one of said leg mounting structures has a respective one of said bipod legs pivotably mounted at a leg retention feature thereof and includes a plurality of leg positioning features spaced around the leg retention feature thereof; wherein the leg retention feature of each one of said leg mounting structures defines a leg rotational axis thereof, wherein the leg retention feature of each one of said leg mounting structures is centrally located between opposing end faces of the first mounting body, and wherein the leg retention feature of each one of said leg mounting structures is positioned between diametrically opposing ones of said leg positioning features thereof; and a second mounting body rotatably mounted within central passage of the first mounting body, wherein the second mounting body includes a cylindrical portion that is rotatably mounted within said substantially round central passage of the first mounting body such that a rotational axis of the second mounting body with respect to the first mounting body extends along a centerline axis of the central passage of the first mounting body, wherein the second mounting includes a firearm mounting structure integral therewith and has a passage extending therethrough, wherein the firearm mounting structure and the passage are jointly configured such that a barrel of the firearm extends through the passage of the second mounting body when the firearm is engaged with the firearm mounting structure, and wherein the firearm mounting structure protrudes from a first end portion of the cylindrical portion of the second mounting body.

2. The bipod of claim 1 wherein the firearm mounting structure portion is an elongated member extending from the first end portion of cylindrical portion of the second mounting body in a direction substantially parallel to the rotational axis of the second mounting body.

3. The bipod of claim 1 wherein:

the first end portion of the cylindrical portion of the second mounting body includes a shoulder structure that abuts an end face of the first mounting body for limiting axial displacement of the second mounting body with respect to the first mounting body in a first direction along the rotational axis; and a second end portion of the cylindrical portion of the second mounting body has a displacement limiting structure engaged therewith for limiting axial displacement of the second mounting body with respect to the first mounting body in a second direction opposite the first direction.

4. The bipod of claim 3 wherein:

the first mounting body is generally cylindrical;

the central passage of the first mounting body defines an interior side surface thereof;

the exterior surface of the first mounting body is a side surface that extends generally parallel with the interior side surface of the first mounting body; and said leg mounting structures extend outwardly from said exterior side surface of the first mounting body.

5. The bipod of claim 1 wherein:

the first mounting body is generally cylindrical;

the central passage of the first mounting body defines an interior side surface thereof;

the exterior surface of the first mounting body is a side surface that extends generally parallel with the interior side surface of the first mounting body; and said leg mounting structures extend outwardly from said exterior side surface of the first mounting body.

6. The bipod of claim 5 wherein the firearm mounting structure portion is an elongated member extending from the first end portion of cylindrical portion of the second mounting body in a direction substantially parallel to the rotational axis of the second mounting body.

7. A bipod for a firearm, comprising:

a plurality of bipod legs;

a first mounting body having two leg mounting structures integral with an exterior surface thereof and having a central passage extending therethrough, wherein each one of said leg mounting structures has a respective one of said bipod legs pivotably mounted at a leg retention feature thereof, wherein each one of said bipod legs pivots about a leg rotational axis extending through the leg retention feature of the respective one of the leg mounting structures, wherein the central passage of the first mounting body is substantially round, wherein the leg retention feature of each one of said leg mounting structures lies on a first side of a horizontal reference plane extending along a centerline axis of the central passage of the first mounting body such that a ground engaging end portion of a respective one of the legs is on a second side of the horizontal reference plane when the respective one of the legs is in a deployed position thereof, wherein each one of the leg mounting structures includes a plurality of leg positioning features spaced around the leg retention feature thereof;

wherein the leg retention feature of each one of said leg mounting structures is positioned between diametrically opposing ones of said leg positioning features thereof, wherein the leg retention feature of each one of said leg mounting structures is centrally located between opposing end faces of the first mounting body, wherein a first one of said diametrically opposing ones of said leg positioning features intersects a first end face of the first mounting body and a second one of said diametrically opposing ones of said leg positioning features intersects a second end face of the first mounting body, and wherein the leg positioning features and leg retention feature of each one of the leg mounting structures are entirely on the first side of the horizontal reference plane;

a second mounting body rotatably mounted within central passage of the first mounting body, wherein the second mounting body includes a cylindrical portion that is rotatably mounted within said substantially round central passage of the first mounting body such that a rotational axis of the second mounting body with respect to the first mounting body extends along a centerline axis of the central passage of the first mounting body, wherein the pivot axis of each one of said bipod legs extends through the rotational axis of the second mounting body with respect to the first mounting body; wherein the second mounting includes a firearm mounting structure integral therewith and has a passage extending therethrough, wherein the firearm mounting structure and the passage are jointly configured such that a barrel of the firearm extends through the passage of the second mounting body when the firearm is engaged with the firearm mounting structure, and wherein the firearm mounting structure portion protrudes from a first end portion of the cylindrical portion of the second mounting body.

8. The bipod of claim 7 wherein the firearm mounting structure portion is an elongated member extending from the first end portion of cylindrical portion of the second mounting body in a direction substantially parallel to the rotational axis of the second mounting body.

9. The bipod of claim 7 wherein:

the first end portion of the cylindrical portion of the second mounting body includes a shoulder structure that abuts an end face of the first mounting body for limiting axial displacement of the second mounting body with respect to the first mounting body in a first direction along the rotational axis; and a second end portion of the cylindrical portion of the second mounting body has a displacement limiting structure engaged therewith for limiting axial displacement of the second mounting body with respect to the first mounting body in a second direction opposite the first direction.

10. The bipod of claim 7 wherein:

each one of the leg mounting structures includes a plurality of leg positioning features integral therewith for being engaged by a mating positioned feature of the respective one of the bipod legs for enabling each one of said bipod legs to be secured in a plurality of positions a defined by said leg positioning features;

said leg positioning features of each one of said leg mounting structures is angularly spaced about the leg rotational axis thereof;

a first one of said leg position features of each one of said leg mounting structures defines a deployed position for the respective one of said bipod legs mounted thereon;

a second one of said leg position features of each one of said leg mounting structures defines a first stowed position for the respective one of said bipod legs mounted thereon;

a third one of said leg position features of each one of said leg mounting structures defines a second stowed position for the respective one of said bipod legs mounted thereon; and the first one of said leg position features is angularly positioned between the second and third ones of said leg position features.

* * * * *